US005080297A

United States Patent [19]

Blaimschein

[11] Patent Number: 5,080,297

[45] Date of Patent: Jan. 14, 1992

[54] CUTTING INSTALLATION FOR CUTTING OUT BLANKS FROM SHEET MATERIAL BANDS

[76] Inventor: Gottfried Blaimschein, Arnhalmweg 33, A-4407 Steyr, Austria

[21] Appl. No.: 481,867

[22] Filed: Feb. 20, 1990

[30] Foreign Application Priority Data

Feb. 21, 1989 [AT] Austria ..... 381/89

[51] Int. Cl.[5] ..... B65H 18/10; B65H 35/02

[52] U.S. Cl. ..... 242/56.8; 242/67.3 R

[58] Field of Search ..... 242/56.8, 56 R, 56 A, 242/67.2, 67.3 R; 83/649, 650, 155, 155.1

[56] References Cited

U.S. PATENT DOCUMENTS 3,360,210 12/1967 Frisbie ..... 242/56.8 X
4,346,855 8/1982 Biggar ..... 242/67.2
4,809,921 3/1989 Dueck et al. ..... 242/56 R

FOREIGN PATENT DOCUMENTS 2040778 1/1979 United Kingdom .

*Primary Examiner*—John M. Jillions
*Attorney, Agent, or Firm*—Collard, Roe & Galgano

[57] ABSTRACT

A cutting installation for cutting out blanks from a sheet material band comprises a cutting table comprising a conveyor band forming a working surface and operable to move in a conveying direction, and a source of low pressure applicable thereto, a cutting head movable over the working surface of the conveyor band, the cutting head comprising a cutting tool, a sheet material band supply station arranged upstream of the conveyor band in the conveying direction, and a sheet material band receiving station arranged downstream of the conveyor band in the conveying direction. To rationalize the cutting operation and enable the waste to be separated automatically, the installation has a waste collector received on the cutting table, the waste collector comprising a carriage reciprocably movable along the conveyor band and including a guide roller extending transversely to the conveying direction and placeable upon the sheet material band, and a driven, rotatable storage roller arranged above the guide roller.

3 Claims, 1 Drawing Sheet

CUTTING INSTALLATION FOR CUTTING OUT BLANKS FROM SHEET MATERIAL BANDS

BACKGROUND OF THE INVENTION (1) Field of the Invention

The present invention relates to improvements in a cutting installation for cutting out blanks from a sheet material band, such as "prepregs" carrying a cover layer on one or both surfaces, which comprises a cutting table comprising a conveyor band forming a working surface and operable to move in a conveying direction, and a source of low pressure applicable thereto, a cutting head movable over the working surface of the conveyor band, the cutting head comprising a cutting tool preferably vertically adjustable to a desired cutting depth, a sheet material band supply station arranged upstream of the conveyor band in the conveying direction, and a sheet material band receiving station arranged downstream of the conveyor band in the conveying direction.

(2) Description of the Prior Art

In the art of manufacturing fiber-reinforced synthetic resins, "prepregs" are understood to be pre-impregnated fibrous structures which are impregnated with a predetermined proportion of a synthetic resin mass which is heat-curable without any additives. These structures may be covered by a film on one or both surfaces thereof and formed into a sheet material band, which may be reeled into a sheet material band supply roll, and this sheet material band is then fed to a suitable cutting installation to cut out blanks of a desired configuration. To minimize waste, the individual blanks should be as close together as possible to form a cutting pattern. The sheet material band is held on the cutting table by the low pressure applied to the working surface and the cutting tool may be an ultrasonically vibrated cutting knife for automatically cutting the blanks out of the sheet material band, the conveyor band of the cutting table being guided above suction boxes under the cutting table. The conveyor band is intermittently moved in the conveying direction to provide the required sections of working surface and, at the same time, serves to convey the sheet material band from the supply to the receiving station, the sheet material band being reeled off onto the conveyor band at the supply station and being deposited from the conveyor band on the receiving station. In these known cutting installations, the sheet material band is cut into respective lengths corresponding to the length of the working surface sections at the supply station and each cut length of the sheet material band is then worked on the cutting table separately, which means that the cutting operation must be adapted to a limited length of cutting pattern. Since the individual blanks are closely spaced in this pattern, this leaves limited freedom of patterning and a correspondingly large amount of waste. Furthermore, it is impossible to separate the blanks from the waste on the cutting table immediately after the blanks have been cut out, except by time-consuming manual labor, and the blanks are delivered to the receiving station together with the waste.

British patent No. 2,040,778 deals with the manufacture of die cut vinyl lettering, wherein a continuous strip of a vinyl film/release coated card laminate is fed onto an intermittently moving carrier band and is thereby moved to a cutting station for cutting letters out of the strip. The resultant blanks are then blown by compressed air into a vacuum box where they are collected on a mesh and the die-cut letter pieces are then deposited in a downstream receiving station by reversing the carrier band. In this way, the waste or scrap is automatically separated but this procedure can be used only for individual, sequentially arranged blanks of a very simple configuration and cannot be used for complex cutting patterns or in cutting installations of the first-described type.

SUMMARY OF THE INVENTION

It is the primary object of this invention to overcome the cited disadvantages and to provide a cutting installation of the type first described hereinabove, which permits a very rational operation with a relatively simple construction, enabling cutting patterns of any length to be worked and also making it possible to separate the waste or scrap automatically.

The above and other objects are accomplished by the invention with a waste collector received on the cutting table, the waste collector comprising a carriage reciprocably movable along the conveyor band and including a guide roller extending transversely to the conveying direction and placeable upon the sheet material band, and a driven, rotatable storage roller arranged above the guide roller.

The movement of the conveyor band is controllable in response to the length of the conveying path to permit any desired increase in the working surface and thus an at least intermittent working of any cutting pattern length, the waste being removed immediately on the cutting table after each cutting operation and being separated from the die-cut blanks. After each conveying step of the conveyor band, the sheet material band length newly moved into the range of the working surface is worked with the cutting head and the waste is subsequently or overlappingly separated, for which purpose the carriage of the waste collector is displaced in a direction opposite to the conveying direction and the waste is pulled over the guide roller placed on the sheet material band and is reeled onto the storage roller. This assumes, of course, that the waste or scrap still has some cohesion even after the die cutting operation and the blanks are retained on the working surface, which is achieved by the grid-like webs remaining in the sheet material band between the cut-out blanks, on the one hand, and the low pressure or vacuum applied to the working surface, on the other hand. Therefore, it is only necessary for the initial portion of the waste to be lifted manually off the blanks at the beginning of the operation and to be guided over the guide roller to the storage roller, whereupon the further waste separation and removal proceeds automatically and continuously by driving the rotatable storage roller synchronously with the movement of the carriage, thus automatically lifting and reeling the waste while the carriage moves along the conveyor band. The only thing remaining on the conveyor band is the sheet material band free of waste, i.e. depending on the type of band, only the blanks or, if a sheet material covered by a film is cut through, the lower covering film and the blanks bonded thereto remain on the conveyor band, and a further conveying step then moves this section of the sheet material band free of the covering film, which is removed as waste, to the receiving station at the end of the cutting table. During the conveying step, the carriage is synchronously displaced back into the initial position, and after the conveying step has been completed, the installation is ready for a subsequent cutting and waste removal operation. Obviously, any type of sheet material may be worked in this manner in strip form.

BRIEF DESCRIPTION OF THE DRAWING

The above and other objects, advantages and features of the present invention will become more apparent from the following detailed description of certain now preferred embodiments, taken in conjunction with the accompanying schematic drawing wherein.

DETAILED DESCRIPTION OF THE PREFERRED EMBODIMENTS

Figure 2:
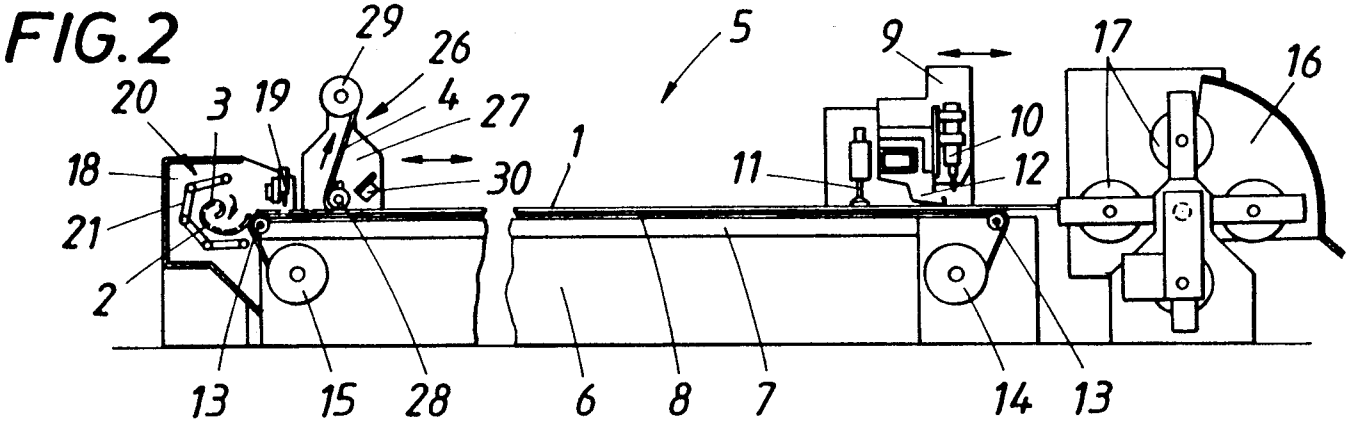
FIG. 2 is a side elevational view, partly in section, of one embodiment of the cutting installation.
Figure 1:
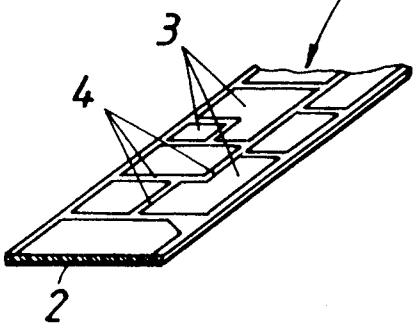
FIG. 1 is a perspective view, partly in section, of a sheet material band to be worked in a cutting installation according to this invention.

Referring now to the drawing, wherein like reference numerals refer to like parts in all figures, FIG. 1 shows sheet material band or strip 1 composed of a synthetic resin layer covered on both surfaces by films 2, out of which blanks 3 are to be cut according to a given cutting pattern and the remaining grid-like connecting webs 4 between the blanks are to be separated as waste or scrap. This is done by cutting installation 5 shown in FIG. 2, which comprises cutting table 6 comprising conveyor band 8 forming a working surface and operable to move in a conveying direction and a source of low pressure applicable thereto, which is illustrated as suction boxes 7 below the conveyor band. Cutting head 9 is movable over the working surface of conveyor band 8 and comprises cutting tool 10, i.e. a cutting knife guided in response to the advance of the conveyor band and vertically adjustable to an exact desired cutting depth. As schematically indicated in FIG. 2, cutting head 9 may be equipped additionally with an advancing device 11, a gripper device 12 and other auxiliary devices used conventionally to facilitate the cutting and material advancing operations.

The sheet material band is advanced on cutting table 6 by conveyor band 8 which is delivered from delivery roll 14 at the supply end of the cutting table and taken up by reeling roll 15 at the opposite table end, being guided from and to the rolls over cutting table 6 by guide rollers 13, 13. A drive (not shown) advances the conveyor band intermittently in dependence on the length of the completed conveying path. When reeling roll 15 has completely taken up the entire length of the conveyor band, the rotation of rolls 14 and 15 is reversed and conveyor band 8 is unreeled from roll 15 and taken up by roll 14. It is now ready for use again. This construction has the advantage of reducing the wear on the conveyor band and makes it possible to change conveyor bands merely by changing the rolls.

Sheet material band 1 is fed in the conveying direction to conveyor band 8 on cutting table 6 by one or more feed rolls 17 at sheet material supply station 16 arranged upstream of the conveyor band in the conveying direction. The sheet material band is pulled off a respective feed roll placed in a delivery position with respect to the conveyor band and is deposited on the conveyor band whose move in the conveying direction unreels the sheet material band from feed roll 17 at a speed synchronized with the cutting operation and finally conveys it to sheet material band receiving station 18 arranged downstream of the conveyor band in the conveying direction.

According to the present invention, cutting installation 5 comprises waste collector 26, which is received on cutting table 6 for separating the waste or scrap from the cut sheet material band. The waste collector comprises carriage 27 reciprocably movable along conveyor band 8 and including guide roller 28 extending transversely to the conveying direction and placeable upon sheet material band 1, and driven rotatable storage roller 29 arranged above the guide roller. When the sheet material band is deposited on conveyor band 8 and cutting head 9 has cut out blanks 3, the waste may be automatically separated from sheet material band 1 by pulling the waste over guide roller 28, as indicated in FIG. 2, and reeling it on storage roller 29 while carriage 27 is displaced in a direction opposite the conveying direction. The operation is initiated manually by clamping the waste coming from guide roller 28 to storage roller 29 and then proceeds automatically by driving the storage roller and displacing the carriage in the indicated manner so that no further manual operation is required for the separation of the waste from the cut-out blanks. After carriage 27 has been displaced over the working surface and the waste has been pulled off by storage roller 29, conveyor band 8 and carriage 27 are synchronously moved in the conveying direction so that the waste collector again reaches its starting position and the cut out sheet material band, freed of waste, is delivered to receiving station 18, whereupon a new operating cycle may begin.

In the illustrated embodiment, cutting device 19 for cutting sheet material band 1 into predetermined lengths is arranged between waste collector 26 and the sheet material band receiving station so that a band whose cut-out blanks remain interconnected may be cut into predetermined lengths, and these lengths of the sheet material band are delivered to receiving station 18. According to this preferred feature, a sheet material band whose cut-out blanks are held in a continuous strip by a base film 2, which remains uncut, may be cut by cutting device 19 into desired lengths after each die-cutting operation or after a succession of such operations so that the die-cut sheet material band is delivered to receiving station 18 in the desired lengths. Since the waste has been separated before the die-cut sheet material band has been cut into predetermined lengths, the waste remains whole and can be separated continuously and without interruption for the entire length of sheet material band 1 so that frequent manual clamping of the waste to storage roller 29 is avoided and the waste separation is rationalized. It is thus possible to work cutting patterns of different lengths and, if desired, blanks forming one cutting pattern or several interconnected cutting patterns may be cut into separate lengths which are received at station 18, the application of low pressure to cutting table 6 being interrupted during the successive conveying steps for operational and economic reasons. Of course, the proper separation of the waste requires the interconnection of webs 4 so that the waste remains in one piece, on the one hand, and the adhesion of blanks 3 to the working surface or to continuous base film 2 after the die-cutting operation, on the other hand, so that a suitable cutting pattern must be chosen, low pressure must be applied to the underside of the cutting table and, in case of a base film covering one side of the sheet material band, this base film must remain uncut.

Figure 4:
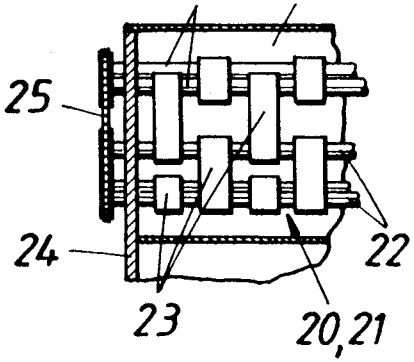
FIG. 4 is a fragmentary end view of a portion of the receiving station.

According to another preferred feature, sheet material band receiving station 18 comprises reeling device 20 for sheet material band 1 to roll up the completed sections of die-cut sheet material band 1 and to remove them from cutting installation 5. This reeling device includes collecting basket 21 having a wall curving upwardly from an inlet of the basket and then rearwardly for guiding base film 2 of the sheet material band along the wall of the collecting basket. The wall is comprised of driven, rotatable rods 22 extending transversely to the conveying direction and, as shown in FIG. 4, respective pairs of rods 22 are interconnected by belts 23. Rods 22 are rotatably journaled in side walls 24 of the collecting basket and are driven by pulley-and-chain drive means 25 s that collecting basket 21 forms a guide path for the die-cut sheet material band freed of waste, which moves in the conveying direction and curves upwardly and rearwardly. As is shown in FIG. 2, this guide path enables the die-cut sheet material band sections to be automatically loosely reeled without a winding core and to be removed immediately from enclosure 20 of the receiving station. The reeling requires no manual operation and the die-cut sections of the sheet material band may be removed without delay in the cutting operation and without interfering therewith in any way. While a curved conveyor band or a suitably arranged air nozzle array may be used at the receiving station for reeling the die-cut sheet material band, the illustrated curved collecting basket wall comprised of driven rods is particularly advantageous in assuring proper and dependable reeling of the die-cut band.

To facilitate the operation of waste collector 26, guide roller 28 of the waste collector is vertically reciprocably guided on carriage 27, and the waste collector further comprises cutting device 30 arranged adjacent to where the guide roller is placeable on sheet material band 1. Lifting of guide roller 28 enables easy insertion of a new sheet material band and also makes it possible to adapt the waste collector to sheet material bands of different thicknesses while the provision of the cutting device enables the separated waste to be cut into sections of any desired length.

Figure 3:
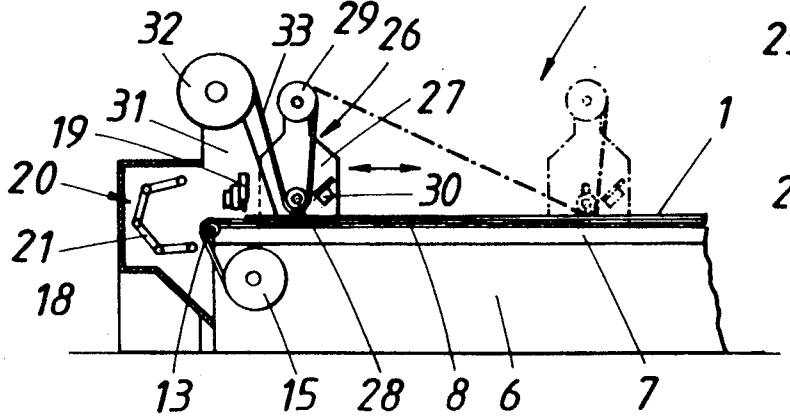
FIG. 3 is a like fragmentary view showing the end of another embodiment of the cutting installation adjacent the sheet material band receiving station.

In the embodiment shown in FIG. 3, cutting installation 5 comprises station 31 for additional sheet material band supply 32 consisting of a roll arranged above conveyor band 8 at an end of cutting table 6 adjacent sheet material band receiving station 18. This makes it possible to use to use waste collector 26 not only for separating the waste from the die-cut sheet material band but also for superimposing two or more bands. For this purpose, sheet material band 33, which comprises a base or carrier film, is fed from additional supply roll 32 and led by guide roller 28 to storage roller 29 where it is clamped to the storage roller. The sheet material band 33 is automatically superimposed on sheet material band 1 fed from conveyor band 8 over guide roller 28 by moving carriage 27 opposite to the conveying direction. When guide roller 28 is raised and the carriage is moved back, a desired length of additional sheet material band 33 is being pulled off supply roll 32, with the carrier film on top. The guide roller is then lowered to press band 33 against band 1 on conveyor band 8, band 33 is cut by cutting device 30 while the carrier film on top of band 33 remains uncut and the reverse movement of carriage 27 causes band 33 coming from roll 32 to be moved over guide roller 28, together with band 1, and the carrier film of band 33 is reeled onto storage roller 29. Repetition of this operating cycle, which requires cutting of band 33 at the start, makes it possible to produce multi-layer sheet material bands so that blanks may be die-cut from such bands. Sequential positioning of such cut sections of multi-layer sheet material bands on the working surface makes it possible to produce multi-layer sheet material bands of desired lengths.

The cutting installation of this invention operates very efficiently and enables the waste to be automatically separated from the die-cut sheet material band on the cutting table as well as to work stepwise any desired lengths of sheet material bands, to cut the die-cut sheet material band free of waste into sections of any desired length, to roll them up and to remove the finished sections at the receiving station.

What is claimed is:

1. A cutting installation for cutting out blanks from a sheet material band, which comprises (a) a cutting table comprising
  (1) a conveyor band forming a working surface and operable to move in a conveying direction, and
  (2) a source of low pressure applicable thereto,
(b) a cutting head movable over the working surface of the conveyor band, the cutting head comprising
  (1) a cutting tool,
(c) a waste collector received on the cutting table, the waste collector comprising
  (1) a carriage reciprocally movable along the conveyor band and including a guide roller extending transversely to the conveying direction and placeable upon the sheet material band, and a driven, rotatable storage roller arranged above the guide roller, and
  (2) means for moving the carriage along the conveyor band while the storage roller is winding the waste material,
(d) a sheet material band supply station arranged upstream of the conveyor band in the conveying direction, and
(e) a sheet material band receiving station arranged downstream of the conveyor band in the conveying direction.

2. The cutting installation of claim 1, wherein the guide roller of the waste collector is vertically reciprocably guided on the carriage, and the waste collector further comprises a cutting device arranged adjacent to where the guide roller is placeable upon the sheet material band.

3. The cutting installation of claim 2, further comprising a station for an additional sheet material band supply arranged above the conveyor band at an end of the cutting table adjacent the sheet material band receiving station.

* * * * *